United States Patent [19]

Böhme et al.

[11] 4,407,415

[45] Oct. 4, 1983

[54] METHOD OF GRADE DETERMINATION INCLUDING COMPENSATION

[75] Inventors: Rolf C. Böhme, Kyalami; Max M. Lazerson, Northcliff, both of South Africa

[73] Assignee: General Mining Union Corporation Limited, South Africa

[21] Appl. No.: 211,444

[22] Filed: Nov. 28, 1980

[30] Foreign Application Priority Data

Dec. 4, 1979 [ZA] South Africa ..... 79/6566
Jul. 15, 1980 [ZA] South Africa ..... 80/4249

[51] Int. Cl.[3] ..... B07C 5/00; B07C 5/346

[52] U.S. Cl. ..... 209/556; 209/576; 209/586

[58] Field of Search ..... 209/555, 556, 558, 576, 209/577, 586, 589

[56] References Cited

U.S. PATENT DOCUMENTS

| | | | |
|---|---|---|---|
| 2,717,693 | 9/1955 | Holmes | 209/576 X |
| 3,052,353 | 9/1962 | Pritchett | 209/558 |
| 3,075,641 | 1/1963 | Hutter et al. | 209/586 X |
| 3,272,332 | 9/1966 | Jones | 209/555 |
| 3,747,755 | 7/1973 | Senturia et âl. | 209/577 X |
| 4,317,521 | 3/1982 | Clark et al. | 209/558 |

FOREIGN PATENT DOCUMENTS

| | | | |
|---|---|---|---|
| 958102 | 1/1957 | Fed. Rep. of Germany | 209/555 |

*Primary Examiner*—Robert B. Reeves
*Assistant Examiner*—Edward M. Wacyra
*Attorney, Agent, or Firm*—Stevens, Davis, Miller & Mosher

[57] ABSTRACT

A method of determining the grade of a radioactive ore particle wherein a grade measurement of the particle e.g. the ratio of its radioactivity to its mass is corrected by means of predetermined calibration factors which are dependent on one or more of the shape, size, density or mass of the particle.

5 Claims, 13 Drawing Figures

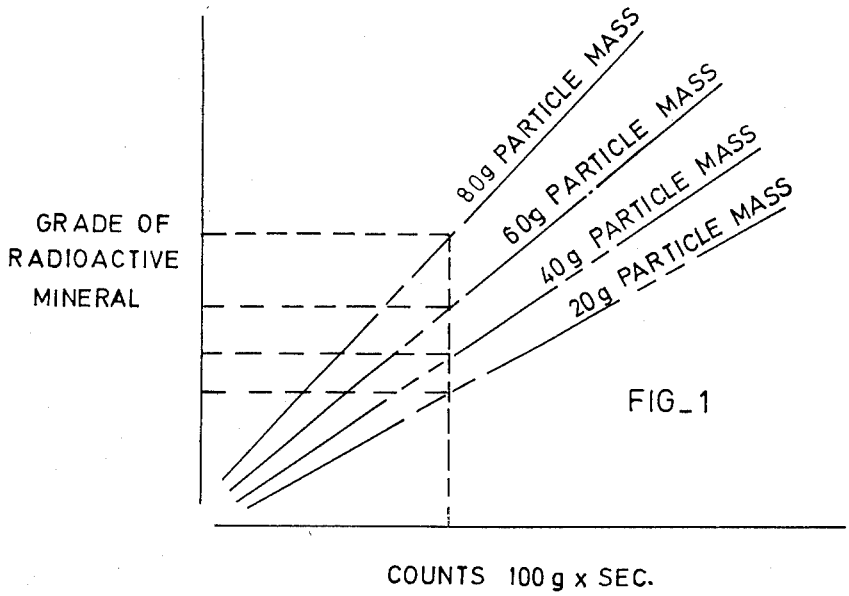
FIG_1
FIG_2
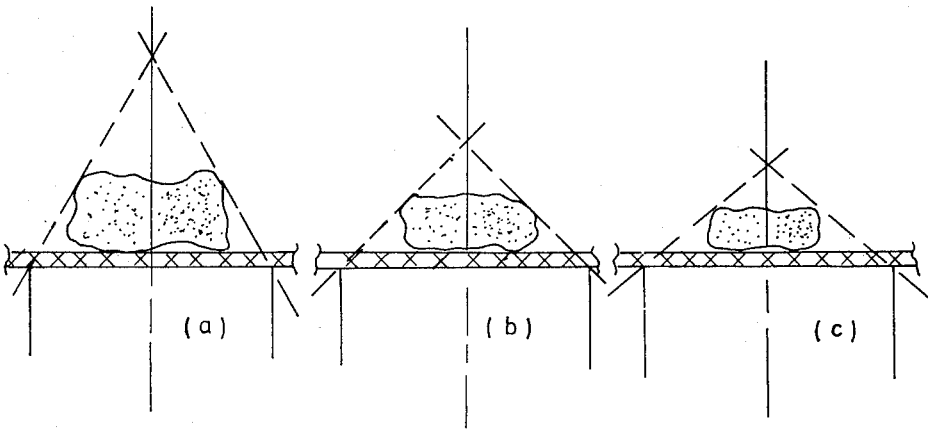
PARTICLES WITH EQUAL COUNTS
AND DIFFERENT MASSES

PARTICLES OF EQUAL MASS AND EQUAL AMOUNTS OF RADIOACTIVE MATERIAL

FIG_5
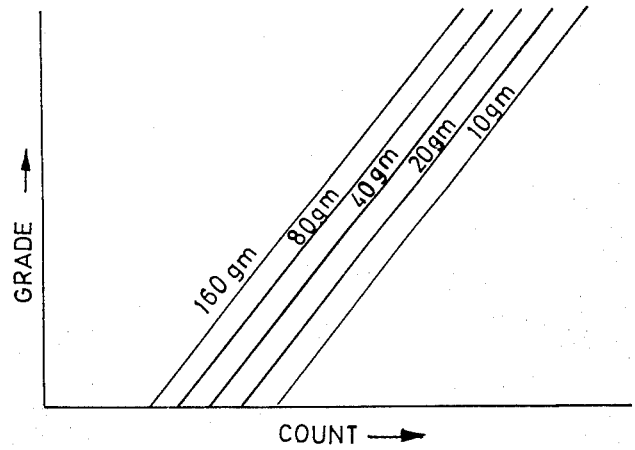
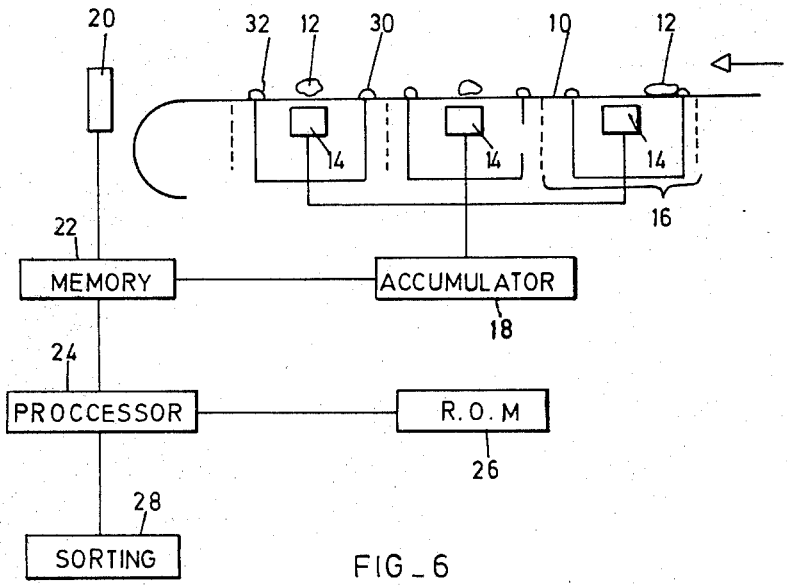
FIG_6

METHOD OF GRADE DETERMINATION INCLUDING COMPENSATION

FIELD OF THE INVENTION

This invention relates to a sorting system and to the correction of, or compensation for, various errors which may materially affect the accuracy of the sorting process.

BACKGROUND TO THE INVENTION

In the sorting of particulate material e.g., radioactive ore, it is necessary to make a grade assessment or measurement of each particle to arrive at a decision on whether to accept or reject the particle. The grade of a particle is essentially a measure of its radioactivity per unit mass and normally is determined by making a volume measurement of the particle, relating the volume directly to its mass, and calculating the ratio of a radioactive count produced by the particle to its mass.

This process is generally acceptable, without adjustment, when the ore is highly radioactive, but various errors due inter alia to the relative sizes of the particles, their densities and their shapes, become significant as the grade decreases and can result in erroneous accept or reject decisions.

To calculate the grade of radioactive material in the particle it is assumed that the count accumulated by radiation detectors during the passage of a specific particle past the detectors is directly proportional to the content of radioactive material in the particle, within the statistical limits of the random nature of emission of radiation by the radioactive material in the particle. It is however only true for a constant size, shape and mass of particle which factors affect the counting geometry as seen by the radiation detectors, and also the self absorption of radiation within the particle. The counting geometry and self absorption of radiation within the particle are extremely dependent on the shape and mass of the particle, so that for a constant mass of radioactive material in a particle, the counts accumulated by the detectors for that specific particle will vary very considerably with the mass of the particle and will not be constant as is assumed for the calculated grade. In practice, it is found that these factors can produce an error of 100% in the calculated grade of a particle with a mass of 50 gm as compared to a particle with a mass of 250 gm.

SUMMARY OF THE INVENTION

According to the invention a method of determining the grade of a particle includes the steps of categorizing the particle into one of a number of predetermined classes, each predetermined class being dependent on at least one physical characteristic of the particle and having associated with it a corrective factor, making a grade measurement of the particle, and applying the respective corrective factor to the grade measurement to determine the grade of the particle.

Each of the predetermined classes may be associated with one of a number of predetermined particle shapes. Alternatively or additionally a number of the classes may be associated with a number of predetermined particle sizes, either volumetric or mass.

Where the grade measurement is based on a per unit volume measurement a corrective factor which takes into account density variations may also be applied.

Also according to the invention there is provided a method of determining the grade of a radioactive particle which includes the steps of obtaining a measure of the radioactivity of the particle, obtaining a measure of the volume of the particle, deriving a measure of the particle's mass from the volume measurement, deriving a grade measurement of the particle from the ratio of the radioactivity measure to the mass measure, categorizing the particle according to its shape, and correcting the grade measurement by applying a corrective factor which is dependent on the category of shape of the particle.

Also according to the invention the corrective factor takes into account density variations which are dependent on the category of shape of the particle.

Further according to the invention the corrective factor takes into account radioactivity count variations which are dependent on the category of shape of the particle.

Also in accordance with the invention the radioactivity of the particle is determined by causing the particle to move past at least one radiation detector, the method including the step for each detector of measuring the radioactivity of the particle only when the particle is within a fixed distance of the detector.

DESCRIPTION OF THE DRAWINGS

The invention is described by way of example with reference to the drawings in which:

FIG. 1 illustrates graphically the relationship of radioactivity grade to radioactive count for particles of different masses, FIGS. 2(*a*), (*b*) and (*c*) illustrate particles of different masses exposed to scintillometers, FIGS. 3(*a*), (*b*) and (*c*) illustrate particles with different shapes, but which are equal in mass and which have equal amounts of radioactive material, exposed to scintillometers, FIG. 5 illustrates corrective curves for particles of different masses (in gm) giving grade, on a log scale, as a function of radioactive count, also on a log scale, FIg. 6 illustrates schematically a sorting system employing the teachings of the invention.

DETAILED DESCRIPTION OF THE INVENTION

Figure 4:
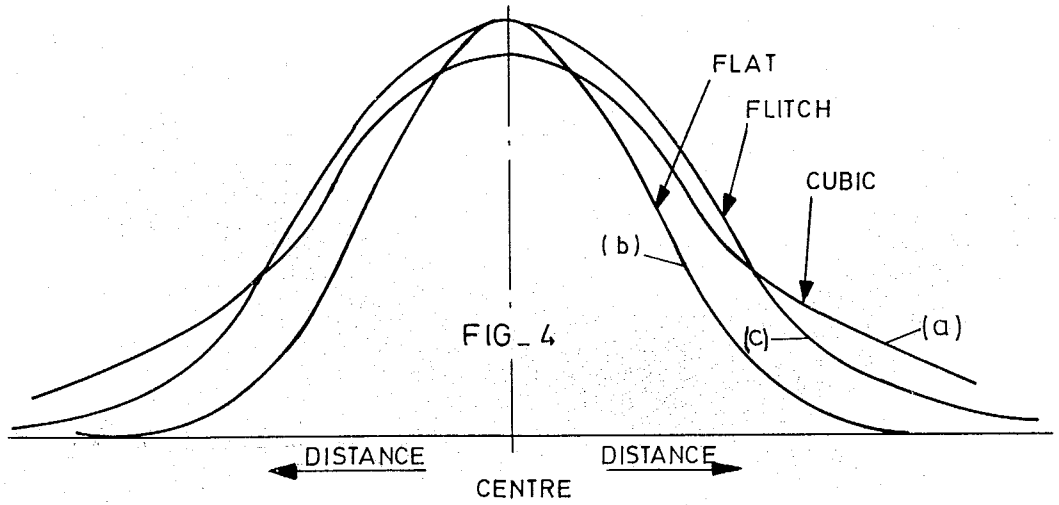
FIG. 4 illustrates the relationship of radioactive count as a function of horizontal distance from a scintillometer for three particles of different shapes.

FIG. 1 is substantially self-explanatory and underlines the fact that particles with different masses which produce equal radioactivity counts are not necessarily of the same grade and consequently, each particle's mass must be accurately determined if its grade is to be correctly computed.

Generally the volume of each particle is determined for example as described in the applicant's co-pending South African patent application No. 80/4250 entitled "Volumetric Measurement", the disclosure of which is herein incorporated, or in any other suitable manner, and the mass of each particle is assumed to be directly proportional to its volume.

That device generally discloses a method of obtaining a volumetric measurement of a particle according to the invention includes the steps of associating with the particle a plurality of contiguous zones, obtaining, for each of the zones, a measure of the volume of the portion of the particle within the zone, and accumulating the measures to derive a volumetric measurement of the particle.

Also according to that invention, the zones extend transversely and preferable at right angles to a first direction along the particle, the zones being parallel to one another. Preferably each zone has the same depth, as measured in the first direction. Measurements are obtained within each zone of the projected widths of the particle in at least two directions transverse to each other.

If the two directions are at right angles to each other the product of the projected widths gives a measure of the cross-sectional area of the particle within the zone, which when multiplied by the depth of the zone, gives a measure of the volume of the portion of the particle within the zone.

Measurements of the projected widths in other directions may also be made to provide some means of compensating for cross sectional shapes which are not substantially rectangular, or which are substantially rectangular but which are not aligned with the two transverse directions.

It should be noted that if all of the above mentioned zones have the same depth the cross-sectional areas may be accumulated and the sum is then multiplied by the depth.

If the relative volumetric measurements of different particles are important then there is no need to multiply the sum of the cross-sectional areas by the depth for the respective sums of different particles will be in the same relationship to one another as the respective volumes.

According to the disclosure of the above-referenced South African patent application the particle is moved in the first direction past a reference location, and the volume measurements for the respective zones are made as they successively pass the location.

Apparatus according to that disclosure includes means for obtaining, for each of a plurality of contiguous zones associated with the particle, a measure of the volume of the portion of the particle within the zone, and means for accumulating the measures to derive a volumetric measurement of the particle. The volume measuring means includes means for obtaining measurements within each zone of the projected widths of the particle in at least two directions transverse to each other, and means for obtaining the product of the two measurements to derive a measure of the cross-sectional area of the particle within the zone.

The means for measuring the projected width may comprise a plurality of collimated radiation sources arranged to illuminate in one direction the portion of the particle within a zone, and a plurality of detector means, each of which is responsive to the radiation from one of the sources, for determining the number of sources which actually illuminate the particle. The radiation sources and detector means may be energized sequentially and in synchronism.

Figure 8:
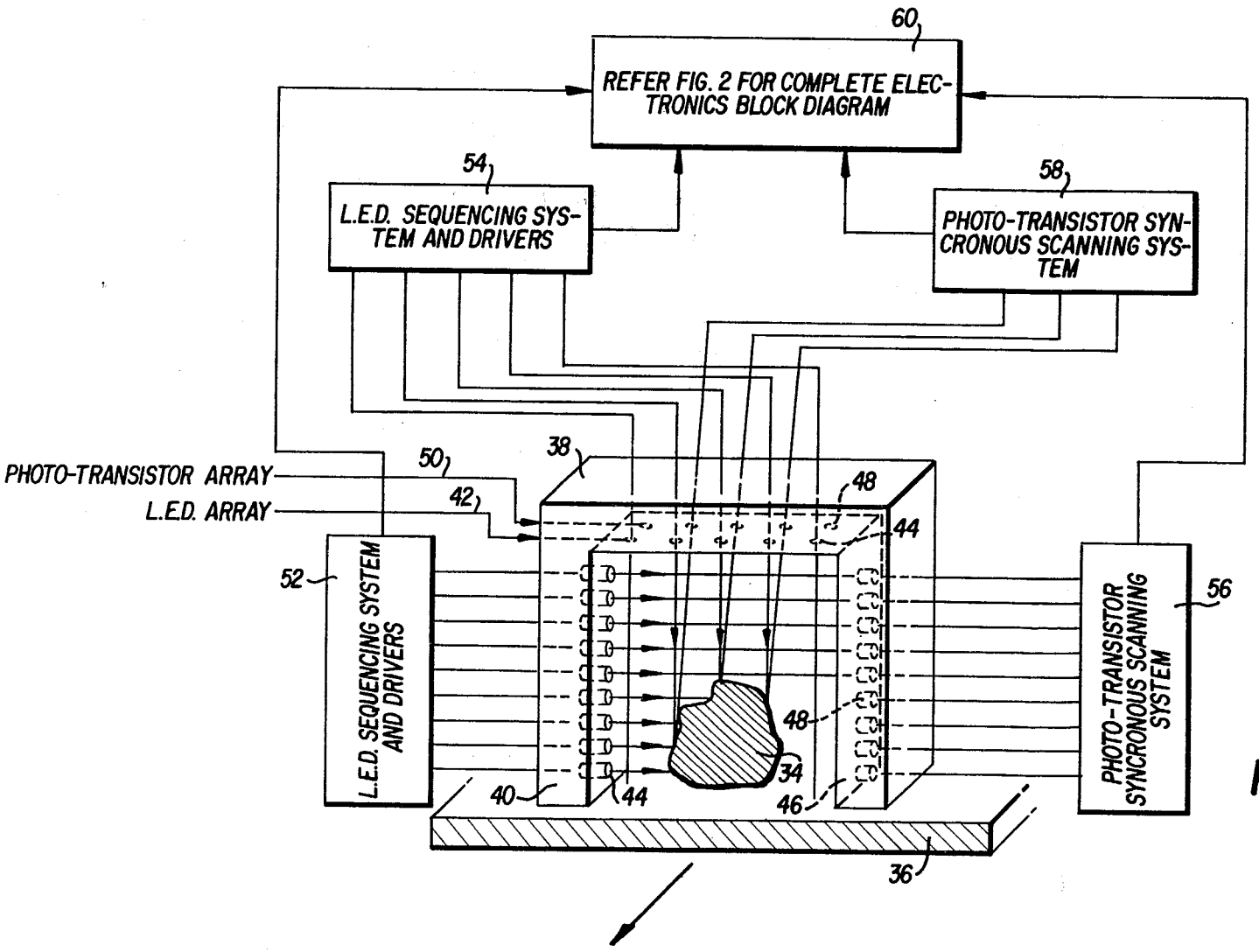
FIG. 8 is a schematic perspective view, partly sectioned, of a first embodiment of a volume measuring device.
Figure 9:
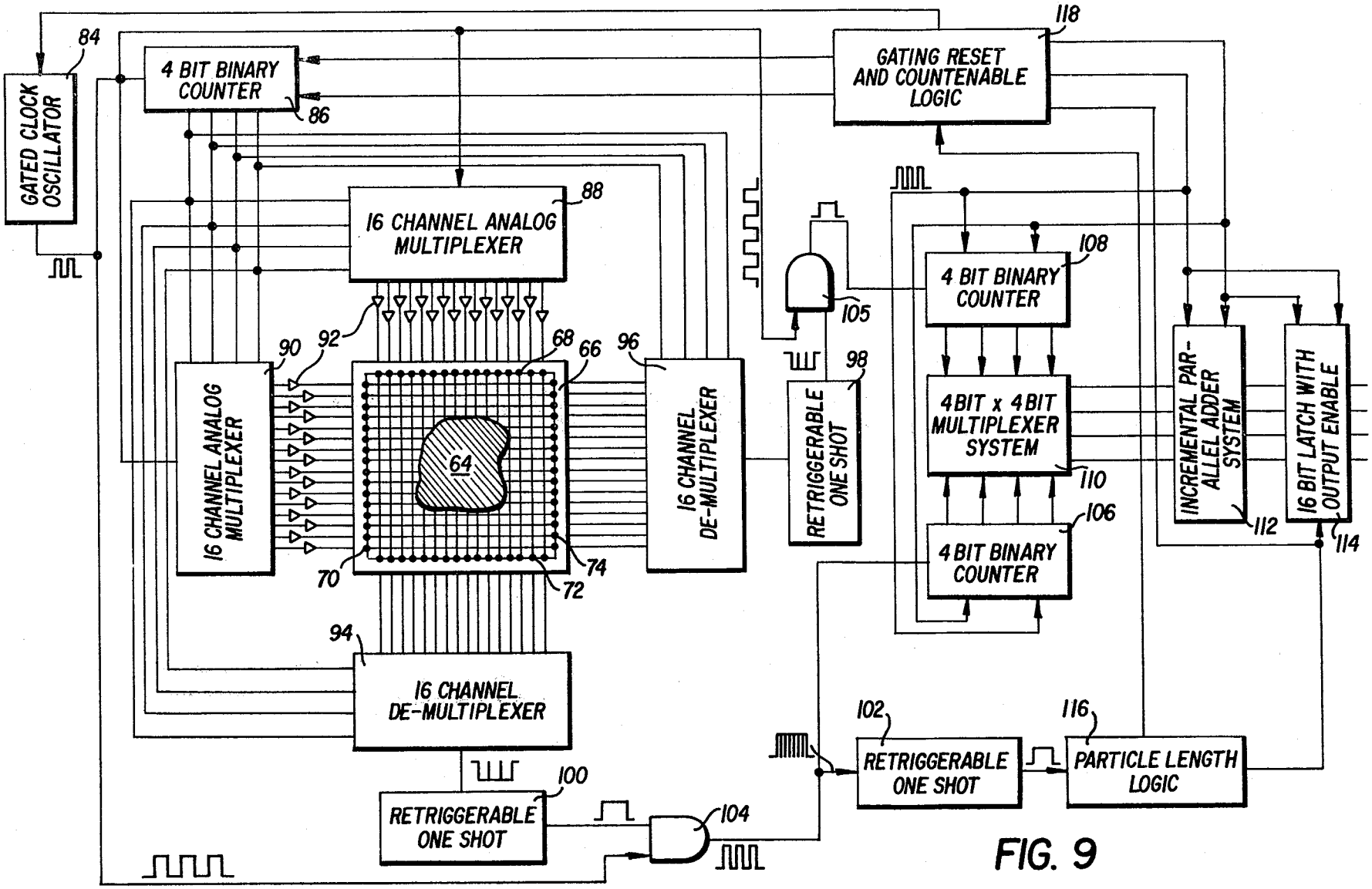
FIG. 9 illustrates a second embodiment of the volume measuring device, including a circuit diagram which may be used with both embodiments.

More specifically, an example of such a volume measuring device can be seen in FIGS. 8 and 9, as will be now explained.

The embodiment of the invention shown in FIG. 8 is designed for the volumetric measurement of a particle 34 located on a moving conveyor belt 36 which is made from a black nonreflective material. FIG. 8 illustrates only one particle but in practice the belt may carry a plurality of rows of particles with the particles in each row being spaced from one another and with the rows also being spaced from each other.

Mounted above the belt is a frame 38 having vertical and horizontal arrays 40 and 42 respectively of partially collimated high intensity pulsed light emitting diodes 44. An array 46 of highly collimated photo transistor light sensors 48 is arranged vertically on the frame opposing the array 40, with each sensor corresponding to a particular diode 44.

Similar sensors are arranged in a horizontal array 50 with each sensor being adjacent and being associated with a particular diode 44 in the array 42.

Each diode has a wider collimation angle than its associated highly collimated photo transistor so that, with regard to the horizontal arrays 42 and 50, each photo transistor can detect light originating from its associated diode and reflected at any point above the belt surface and below the upper limb of the frame 38.

The diodes in each array 40 and 42 are sequentially pulsed by drivers 52 and 54 respectively and the corresponding arrays 46 and 50 of photo transistors are synchronously scanned by means of scanners 56 and 58 respectively. Thus each transistor is only responsive to light which is emitted by its corresponding light emitting diode.

Consequently as the particle 34 is moved by the belt past the frame successive zones of the particle, which extend transversely to its direction of travel, are illuminated and scanned. In this way, by suitable selection of the synchronous sequential pulsing and scanning rate a scan resolution of approximately 5 mm can be achieved using commercially available very small light emitting diodes and photo transistors.

Thus, by counting the number of transistors in the vertical array 46 which are not illuminated directly in each scan by the diodes in the array 40 the projected height of the particle over a zone approximately 5 mm deep is determined.

Similarly, by counting the number of transistors in the horizontal array 50 which are illuminated by light emitted by the diodes in the array 42 and then reflected from the particle the projected width of the particle over the same zone is determined.

The product of the projected height and width is a measure of the projected cross-sectional area of the portion of the particle within the zone i.e. in a direction which is transverse to the direction of travel of the particle.

The data derived in this way from the various arrays is fed to a computing circuit 60, hereinafter described with reference to FIG. 9. By suitable timing of the scanning rates the projected cross-sectional area of contiguous 5 mm deep zones or slices of the particle are determined and by summing these projected areas of the zones along the length of the particle in its direction of travel the projected volume of the particle is derived.

The arrangement shown in FIG. 9 is intended for the volumetric measurement of a particle 64 projected in free flight from the end of a conveyor belt through a frame 66. The frame carries arrays of light emitting diodes and photo transistors which may be identical to those of FIG. 8, i.e. arranged to be responsive to directly transmitted light and to reflected light. The arrays may alternatively be responsive to reflected light only but it is most convenient if the arrays correspond to the vertical arrays 40 and 46 of FIG. 8, i.e., the system is based on the detection of directly transmitted light.

Thus in FIG. 9 the numerals 68 and 70 denote horizontal and vertical arrays respectively of light emitting diodes, and the numerals 72 and 74 denote corresponding horizontal and vertical arrays respectively of photo transistor sensors.

In other respects the operation of the arrangement is analogous to that of FIG. 8 and will not be elaborated on for, as before, the projected cross-sectional area of each of a plurality of contiguous zones of the particle is obtained, with the zones extending successively in the direction of travel of the particle, and these areas are summed to obtain a measure of the projected volume of the particle.

Consequently the following description is largely confined to a discussion of the manner in which the circuitry, designated generally as 60 in FIG. 8, works.

The circuitry includes a clock oscillator 84, a four bit binary counter 86, two 16 channel analog multiplexers 88 and 90 associated with the horizontal and vertical arrays of diodes respectively, high power driver circuits 92, two corresponding 16—channel de-multiplexers 94 and 96 respectively, retriggerable one-shots (astable multivibrators) 98, 100 and 102, AND gates 104 and 105, four bit binary counters 106 and 108, a multiplier 110, a parallel adder 112, a latch 114 and logic units 116 and 118 respectively. The latter logic unit is used for gating, reset, and count enable, logic. The former unit is used to detect the length of the particle in its direction of travel. The clock oscillator 84 drives the 4-bit binary counter 86. The 4-bit output of the binary counter 86 is decoded by the 16 channel analog multiplexer 90 which sequences the diodes in the vertical array 70, and by the multiplexer 80 which sequences the diodes in the horizontal array 68. The outputs of the multiplexers are fed to the high power driver circuits 92 which drive the light emitting diodes to give very high intensity light pulses.

The action of each multiplexer is sequentially to pulse the light emitting diodes in each array as described. The associated light detecting photo transistor outputs are fed in parallel to the 16 channel demultiplexers 96 in the vertical plane and 94 in the horizontal plane. As these demultiplexers are synchronously driven by the binary counter 86 the pulse sequence output of the demultiplexers corresponds to the sequential pulsing of the respective diode arrays, and a high or low logic pulse is obtained from each photo transistor depending on whether it is obscured or not.

The outputs of the demultiplexers are passed to the retriggerable one shots 100 and 98, respectively, setting the width and height of the particle. The width pulse is used to gate the clock pulse through the AND gate 104 and the height pulse gates the clock pulse through the AND gate 105. The outputs of the gates are passed to the counter 108 for the vertical plane, and to the counter 106 for the horizontal plane.

The gating-, reset- and count enable logic section 118 resets the binary counters at the beginning of each scan, and stops the binary counters at the end of each scan cycle.

Thus at the end of each scan cycle a count corresponding to the number of photo transistors obscured in the vertical plane is stored in the binary counter 106 and a count corresponding to the number of photo transistors obscured in the horizontal plane is stored in the binary counter 108. The binary outputs of these counters are fed to the 4-bit×4-bit multiplier system 110, and the 16 bit output of this multiplier, corresponding to the projected cross-sectional area of a 5 mm long slice of the particle is passed to the incremental parallel adder system 112. The incremental adder system is reset to zero by the gating-, reset- and count enable logic system 108 when an incoming particle is first detected by the photo transistors, and a 16-bit multiplier product representing the cross-sectional area of a 5 mm slice is then added incrementally, or accumulated, at the end of each sequential scan of the particle, the total summation over the length of the particle thus being the projected volume of the particle. After the end of the particle has been detected by the particle length logic unit 116, the output latch 114 is enabled and the output of this latch representing the projected particle volume is then available for further processing as required.

The circuit elements and arithmetic and logic blocks shown in FIG. 9 are all standard circuit elements well known to those skilled in the digital electronic art, so full circuit details are not given. The system shown comprises a 16 element array, with a corresponding electronic system, but this array can obviously be expanded to arrays with more elements.

The systems as described provide a volumetric measurement, in the nature of a measurement of the projected volume, of each particle. If desired an emperial factor can be applied to determine the mass of the particle.

Due to the physical dimensions of the light emitting diodes the measurements of the particle size are taken in steps of approximately 5 mm. This is adequate for large particles e.g. in excess of 25 mm, but inadequate for particles of the order of 10 mm. For these particles measurements have to be taken in discrete steps of the order of 1 mm.

A resolution of this magnitude may be achieved with the aid of a scanning camera, or other optical system, in the nature of that described in the applicants' co-pending South African patent application No. 80/3656, the disclosure of which is herein incorporated.

With the scanning camera and a second set of mirrors, a measurement at 45° to the first one can be taken that time later that it takes for the particle to move to the next set of mirrors. This means that a second set of readings can be taken and used to compute the volume more accurately. The lesser of the two readings is taken to compute the volume.

The correctness of this step is based on the assumption that the densities of the respective particles are, within reasonable limits, the same. It has been established empirically, however, that the specific density of particles from certain ores varies widely, e.g. from 2,12 to 3,18 and, in addition, that in many instances the density of a particle is dependent on its shape. Thus in accordance with one aspect of the invention a particle is categorized according to its shape and a correction factor which takes into account shape—dependent density variations is applied to the volumetric measurement of the particle.

One way in which the particles are categorized according to shape is explained subsequently in this specification.

It is established practice in the art of ore sorting to employ electronic computational aids, e.g., microprocessors, to process data to arrive at the accept or reject decision for each ore particle and the efficient use of a microprocessor is within the scope of one skilled in the art. Consequently the routine programming of the microprocessor will not be elaborated on. It should be evident, though, that the microprocessor can readily be programmed to process the determined volume so as to give a statistically corrected mass.

FIGS. 2(*a*), (*b*) and (*c*) illustrate particles of different masses in each case directly overlying a scintillometer. The particles produce equal radioactivity counts and therefore are of different grades.

These Figures also make it clear that the size of a particle influences the radioactive count. In each Figure the angle subtended by the active area of the scintillometer which just grazes the perimeter of the particle is shown by means of dotted lines. It is noticeable that the angle descreases with increasing particle size and that consequently the radiation detected is dependent on the geometry of the detector, and on the particle size. In addition there is a loss of counts due to self absorption of radiation within the particle and this is related to particle size.

A correction factor which takes account of a particle's size, i.e., its mass, may be applied to its radioactivity count to arrive at a corrected grade measurement. The correction factors are obtained as follows:

A large number of particles with masses varying from the minimum handled by the sorting system to the maximum handled by the sorting system, preferably with uniform reproducible shapes, and with a content of concentrations or grades normally handled by the sorting system, are individually counted under standard conditions simulating the counting system of the sorter. These particles are then individually assayed for radioactive material content by chemical or other means and from the data a series of calibration curves of counts per second per gram particle mass against particle grade are drawn up for a series of different particle mass groups. Typical curves produced in this way are shown in FIG. 5 where grade, on a log scale, is plotted against count, also on a log scale, with the particle mass, in gm, as a parameter.

From these calibration curves correction factors for the appropriate particle mass groups are derived to compute the particle grades more accurately on the sorting machine. The computation of grade for each particle passing through the sorting machine is done by means of a microporcessor system and the appropriate factors to compute the grade including the necessary correction factors, are entered into the Random Access Memory of the Microprocessor to be used in the computation programme as required.

Figure 3:
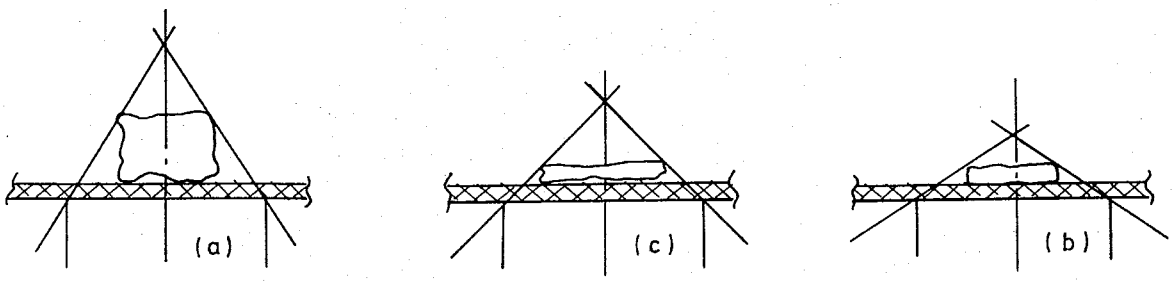

FIGS. 3(*a*), (*b*) and (*c*) illustrate the geometry for particles of equal mass and equal radioactivity but with shapes denoted cubic, flat or flitch, which terms are hereinafter defined, and FIG. 4 illustrates the counts for these particles as a function of distance from the scintillometer centre.

The flat and the flitch particles, which are shown in FIG. 3 as having roughly the same thickness, have the same count when directly at the centre of the scintillometer. The cube, however, because of its greater self absorption, has a lower maximum count.

The count for the flat tapers off more rapidly than for the flitch: this is because the flitch is longer than the flat and a relatively greater proportion of it is exposed to the scintillometer as it is displaced from the scintillometer than what is the case for the flat.

The count for the cube tapers off the least rapidly. This is because the scintillometer is responsive to radiation from the upper portions of the cube, because of its greater height, when the cube is displaced from the scintillometer whereas for the flat and the flitch particles a displacement from the scintillometer rapidly takes the particle beyond the range of the scintillometer.

The different shapes result from the geological characteristics of the ore which during mining and subsequent crushing breaks along its weakest planes.

For this application the different particle shapes have been limited to three which are defined as follows, where a = length i.e., the greatest linear dimension of a particle, b = width i.e., the maximum linear dimension of the particle at right angles to its length.

c = height i.e., the maximum linear dimension of the particle at right angles to its length and width.

| | | |
|---|---|---|
| "cubic" | | $a > b > \frac{1}{2}a$ |
| | and | $a > c > \frac{1}{2}a$ |
| "flat" | | $a > b > \frac{1}{2}a$ |
| | and | $c < \frac{1}{2}a$ |
| "flitch" | | $b < \frac{1}{2}a$ |
| | and | $c < \frac{1}{2}a$ |

It has been found that certain ores contain 60% "cubics", 30% "flats" and 10% "flitches". The definitions of the shapes have been given in this example in terms of maximum linear dimensions but this is not necessarily so and the definitions could be formulated in terms of average linear dimensions.

The possible shapes are by no means exhaustive and for certain ores it may be possible to recognize more or fewer basic shapes. The important point is that each basic shape has, within limits, a predictable effect, which is empirically determined, on the radiation count.

By means of fundamental measuring techniques and through the use of a number of statistically representative particle samples of the different basic shapes, and falling in different mass categories, a series of curves similar to those of the type shown in FIG. 4 can be produced, much in the same manner as the curves of FIG. 5, and the data derived therefrom can be employed to generate correction factors which are utilized in the microprocessor program to compute statistically corrected grade determinations.

FIG. 6 is a schematic representation of a sorting system which embodies the principles set forth thus far. The system includes a conveyor belt 10 which feeds a plurality of in-line and mutually spaced particles 12 sequentially past a line of radiation detectors 14 each of which has an effective counting zone 16.

Each detector is responsive to the radiation from the particular particle in its counting zone at any given time and the counts of the individual detectors associated with a given particle are accumulated by an accumulator 18, for example in the manner described in South African patent application No. 78/3198 entitled "Improvements Relating to Sorting Systems".

Apparatus 20, of the type described in the applicant's South African patent application No. 80/4250 entitled "Volumetric Measurement" is located adjacent the belt to provide a measure of the volume of each particle.

The accumulated count, and the volume measurements are correlated and stored in a memory 22 of a microprocessor 24. A read only memory 26, pre-programmed with correction data of the type referred is interfaced with the processor 24.

For each volume measurement a mass determination can be made. In addition the data generated in determining the volume of a particle can be employed, for example, on the basis of the rules or definitions already laid out, to categorize the particle according to its shape.

Depending on data determined statistically from representative samples of the ore to be sorted the correction data held in the memory 26 may include at least the following: (a) correction factors for density variations which are dependent on shape, volume or some other parameter (b) correction factors e.g., of the kind shown in FIG. 5 which take into account the mass of each particle, and, (c) correction factors e.g., of the kind shown in FIG. 4 which take into account the shape of each particle.

For each particle 12 the processor 24 executes a look up routine to read the appropriate correction factors from the memory 26 and thereafter to correct the mass measurement for the particle. The ratio of the count to the corrected mass measurement gives the grade of the particle and an accept/reject decision is then made by the processor in accordance with predetermined criteria and standard sorting apparatus 28 e.g. air blast nozzles, is actuated to sort the particles.

Figure 7:
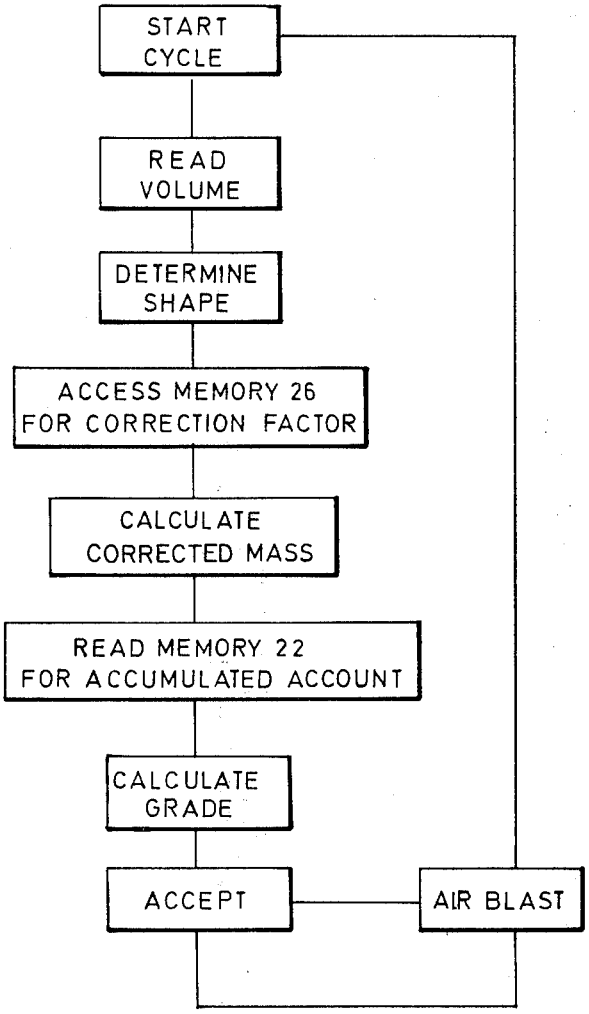
FIG. 7 is a simplified flow chart of a computer programme executed by the system of FIG. 6.

FIG. 7 illustrates a simplified flow chart of the programme executed by the processor 24. The flow chart is largely self explanatory and illustrates a computing cycle for a single particle. Clearly, if there are parallel rows similar computations could take place simultaneously in parallel or use could be made of time sharing techniques to enable all the computations to be performed by a single processor.

Another factor which is taken into account with the present invention is that the counts on which the grade determinations are based must be taken under the same conditions for the different particles.

As the counts per unit time received by each of the scintillometer crystal detectors are a function of the distance between the particle and the crystal, and are a maximum when the particle passes the centre of the crystal, and as the background is not affected by the movement of the particle, it is essential to start counting the radiation from the approaching particle when the counting rate is a fair proportion of the peak counting rate, that is when the particle is on or relatively near the centre-line of the crystal.

The counting time is therefore started when the particle approaches the scintillation counter at a fixed distance from the counter, and stopped the same distance after the counter.

This can be achieved by means of light gates 30 and 32 at the entry and exit respectively of each of the counting zones. The light gates simply detect the presence of a particle 12 and control the transfer of data from the detectors 14 to the accumulator 18. A similar effect can be achieved by storing the counts in buffer registers between the detectors 14 and the accumulator 18 at fixed time intervals and only withdrawing those counts from the register that have been registered when the particle was in the counting zone.

What is claimed is:

1. A method of determining the grade of a radioactive particle which includes the steps of obtaining a measure of the radioactivity of the particle, obtaining a measure of the volume of the particle, deriving a measure of the particle's mass from the volume measurement, deriving a grade measurement of the particle from the ratio of the radioactivity measure to the mass measure, and correcting the grade measurement by applying a corrective factor which is dependent on the mass of the particle.

2. A method of determining the grade of a radioactive particle which includes the steps of obtaining a measure of the radioactivity of the particle, obtaining a measure of the volume of the particle, deriving a measure of the particle's mass from the volume measurement, deriving a grade measurement of the particle from the ratio of the radioactivity measure to the mass measure, categorizing the particle according to its shape, and correcting the grade measurement by applying a corrective factor which is dependent of the category of shape of the particle.

3. A method according to claim 2 wherein the corrective factor takes into account density variations which are dependent on the category of shape of the particle.

4. A method according to claim 2 wherein the corrective factor takes into account radioactivity count variations which are dependent on the category of shape of the particle.

5. A method according to claim 2 wherein the radioactivity of the particle is determined by causing the particle to move past at least one radiation detector, the method including the step for each detector of measuring the radioactivity of the particle only when the particle is within a fixed distance of the detector.

* * * * *